US008233811B2

(12) United States Patent
Itoyama et al.

(10) Patent No.: US 8,233,811 B2
(45) Date of Patent: Jul. 31, 2012

(54) IMAGE STABILIZING APPARATUS AND IMAGE FORMING APPARATUS

(75) Inventors: Motoyuki Itoyama, Kizugawa (JP); Syouichi Fujita, Kashiba (JP); Mitsuhiro Murata, Yao (JP); Toshiaki Fujisawa, Nara (JP); Masaya Fujitani, Uji (JP)

(73) Assignee: Sharp Kabushiki Kaisha, Osaka (JP)

( * ) Notice: Subject to any disclaimer, the term of this patent is extended or adjusted under 35 U.S.C. 154(b) by 875 days.

(21) Appl. No.: 12/254,269

(22) Filed: Oct. 20, 2008

(65) Prior Publication Data

US 2009/0110414 A1 Apr. 30, 2009

(30) Foreign Application Priority Data

Oct. 24, 2007 (JP) ..... 2007-276390

(51) Int. Cl.
*G03G 15/08* (2006.01)

(52) U.S. Cl. ..... 399/30; 399/58

(58) Field of Classification Search ..... 399/30, 399/58, 63

See application file for complete search history.

(56) References Cited

U.S. PATENT DOCUMENTS

| | | | | |
|---|---|---|---|---|
| 5,124,751 | A | 6/1992 | Fukui et al. | |
| 2003/0228164 | A1 * | 12/2003 | Katoh | 399/30 |
| 2006/0029405 | A1 * | 2/2006 | Tanaka et al. | 399/27 |

FOREIGN PATENT DOCUMENTS

| | | | |
|---|---|---|---|
| JP | 4-19764 | A | 1/1992 |
| JP | 11-295976 | A | 10/1999 |
| JP | 2000-214672 | | 8/2000 |
| JP | 2001-75438 | A | 3/2001 |
| JP | 2003-215904 | A | 7/2003 |
| JP | 2004-125829 | | 4/2004 |
| JP | 2006-337699 | | 12/2006 |
| JP | 2007-147782 | | 6/2007 |
| JP | 2007-233090 | | 9/2007 |

OTHER PUBLICATIONS

Japanese Office Action mailed Sep. 1, 2009 in corresponding Japanese application 2007-276390.

English computer translation of JP Patent Publication 2000-214672 (patent publication with English Abstract previously submitted with the IDS filed Oct. 20, 2008), Aug. 2000.

English computer translation of JP Patent Publication 2004-125829 (patent publication with English Abstract previously submitted with the IDS filed Oct. 20, 2008), Apr. 2004.

Chinese Office Action mailed Mar. 30, 2010 in corresponding Chinese application 200810172914.0.

* cited by examiner

*Primary Examiner* — David Gray
*Assistant Examiner* — Roy Y Yi
(74) *Attorney, Agent, or Firm* — Nixon & Vanderhye P.C.

(57) ABSTRACT

There is provided an image stabilizing apparatus which is capable of keeping a toner concentration and a printing density constant when toner consumption is small, and further which is systematically simple. The image stabilizing apparatus comprises a control portion for controlling a toner replenishment amount in a toner replenishing apparatus depending on a toner concentration detected by a toner concentration sensor and a print coverage of a document detected by a print coverage detecting portion, and controlling, when the print coverage of the document detected by the print coverage detecting portion is less than a predetermined value and such documents continue, so as to discharge a predetermined amount of toner to the image bearing member by developing forcibly, and then replenish the same amount of toner as the predetermined amount by the toner replenishing apparatus.

14 Claims, 4 Drawing Sheets

30a

| DOCUMENT PRINTING RATE | TONER REPLENISHMENT AMOUNT TO BE DRIPPED | TONER DISCHARGE |
|---|---|---|
| OVER 7% | SMALL | OFF |
| OVER 3% AND LESS THAN 7% | MEDIUM | OFF |
| LESS THAN 3% | LARGE | ON |

IMAGE STABILIZING APPARATUS AND IMAGE FORMING APPARATUS

CROSS-NOTING PARAGRAPH

This Nonprovisional application claims priority under 35 U.S.C. §119(a) on Patent Application No. 2007-276390 filed in JAPAN on Oct. 24, 2007, the entire contents of which are hereby incorporated herein by references.

FIELD OF THE TECHNOLOGY

The present technology relates to an image stabilizing apparatus in an image forming apparatus using an electrophotographic method, such as a copier, a printer, or the like, and the image forming apparatus.

BACKGROUND OF THE TECHNOLOGY

An electrophotographic image forming apparatus is roughly classified into a one-component developing apparatus using one-component toner and two-component developing apparatus using two-component developer including non-magnetic toner and magnetic carrier, to form a toner image.

Since the one-component developing method is suitable for compactification, but not for high-speed development, a high-speed and long-life image forming apparatus often employs the two-component developing apparatus. In the developing apparatus using the two-component developer, while carrier itself in the two-component developer is not reduced because it is not consumed and remains inside the apparatus, toner is consumed and reduced by development. Hence, in order to stabilize quality of an image, the toner is suitably replenished so as to maintain a constant toner concentration of the two-component developer.

Although the toner concentration can be controlled using various methods, generally used is a toner concentration sensor so that toner replenishment is performed when exceeding a predetermined value. As the toner concentration sensor, for example, a magnetic permeability sensor utilizing that a magnetic permeability of two-component developer varies in accordance with a toner concentration thereof, is used.

Furthermore, in recent years, a system for detecting a toner concentration with other sensors, in addition to the toner concentration sensor, has been considered. For example, Japanese Laid-Open Patent Publication No. 2000-214672 discloses an image forming apparatus which is provided with toner concentration detecting means, image density detecting means for detecting an image density of a reference toner image formed on a surface of an image bearing member, print coverage calculating means for obtaining a print coverage of an image from input image information, and toner replenishment control means for detecting toner consumption based on calculation result by the print coverage calculating means, so as to control toner replenishment by toner replenishing means based on the detected toner consumption, detection result by the toner concentration detecting means, and detection result by the image density detecting means.

Furthermore, Japanese Laid-Open Patent Publication No. 2004-125829 discloses an image forming apparatus provided with rotational frequency counting means for counting rotational frequency of a developer carrier, image dot counting means for counting dot number of an image formed on the developer carrier, and control means for performing developing operation from the developer carrier to an image bearing member when the image dot number in a given rotational frequency is less than a predetermined threshold.

The toner concentration sensor sometimes takes time for circulating developer, and therefore can not detect a toner concentration instantly. Hence, until all circulation is finished (for example, about 10 printing sheets), toner replenishment is performed based on a value of a print coverage of a document (or dot count number) to realize more accurate correction of a toner concentration.

However, in a case where, the magnetic permeability sensor and the print coverage of the document (or the dot count number) are used as means for judging control of a toner concentration, there is a problem that, when documents having a low print coverage continue (that is, when toner consumption is small and toner is replenished little by little based on the print coverage of the document), a solid density gets lower. Note that, replenishing toner little by little is referred to also as "toner drip".

The problem is considered to be caused by deterioration of toner, in other words, by that toner near carrier is not replaced and therefore receives too much stress. Against this, as described in the Japanese Laid-Open Patent Publication No. 2004-125829, a method for forcibly discharging toner is considered.

However, the image forming apparatus described in the Japanese Laid-Open Patent Publication No. 2004-125829 employs one-component developer and bulk change of the developer is considerably large at the time of forced discharge, thus taking time for toner discharge/replenishment, furthermore, without having the toner concentration sensor, the image forming apparatus is not suitable for high-speed and high-density printing.

Furthermore, since the image forming apparatus described in the Japanese Laid-Open Patent Publication No. 2004-214672 employs three kinds of sensors, it takes time to obtain detection result and control is also complicated.

SUMMARY OF THE TECHNOLOGY

An object of the present technology is to provide an image stabilizing apparatus which is capable of keeping a toner concentration and a printing density constant when toner consumption is small, and further which is systematically simple, and to provide an image forming apparatus equipped with the image stabilizing apparatus.

An object of the present technology is to provide an image stabilizing apparatus, comprising a developing apparatus which stores two-component developer including toner and carrier, for developing an electrostatic latent image formed on an image bearing member, a magnetic permeability sensor for detecting a toner concentration in two-component developer in the developing apparatus, a print coverage detecting portion for detecting a print coverage of a document, a toner replenishing apparatus for replenishing toner to the developing apparatus, and a control portion for controlling a toner replenishment amount in the toner replenishing apparatus depending on the toner concentration detected by the magnetic permeability sensor and the print coverage of the document detected by the print coverage detecting portion, and controlling, when the print coverage of the document detected by the print coverage detecting portion is less than a predetermined value and such documents continue, so as to discharge a predetermined amount of toner to the image bearing member by developing forcibly, and then replenish the same amount of toner as the predetermined amount by the toner replenishing apparatus.

Another object of the present technology is to provide the image stabilizing apparatus, wherein the control portion controls so as to forcibly perform replenishment with a toner of the amount specified based on the print coverage of the document detected by the print coverage detecting portion independently of the toner concentration detected by the magnetic permeability sensor.

Another object of the present technology is to provide the image stabilizing apparatus, wherein the control portion changes a threshold of the print coverage of the document concerning the replenishment amount, depending on a rotational speed of the image bearing member.

Another object of the present technology is to provide the image stabilizing apparatus further comprising a nonvolatile memory, wherein the print coverage detecting portion obtains an average print coverage of the document until discharge by developing is performed by the control portion while storing the detected print coverage of the document in the nonvolatile memory, to provide to the control portion.

Another object of the present technology is to provide the image stabilizing apparatus, wherein the control portion controls so as to discharge toner by developing forcibly when the average print coverage of the document per predetermined number of sheets is obtained from the print coverage of the document detected by the print coverage detecting portion, and the obtained value is less than the predetermined value.

Another object of the present technology is to provide the image stabilizing apparatus, wherein the control portion increases the predetermined amount depending on a degree of deterioration of the two-component developer.

Another object of the present technology is to provide an image forming apparatus which includes any of the aforementioned image stabilizing apparatus.

Another object of the present technology is to provide the image forming apparatus, wherein the control portion carries out control when reaching a predetermined cumulative development time or at a predetermined timing.

PREFERRED EMBODIMENTS OF THE TECHNOLOGY

Figure 1:
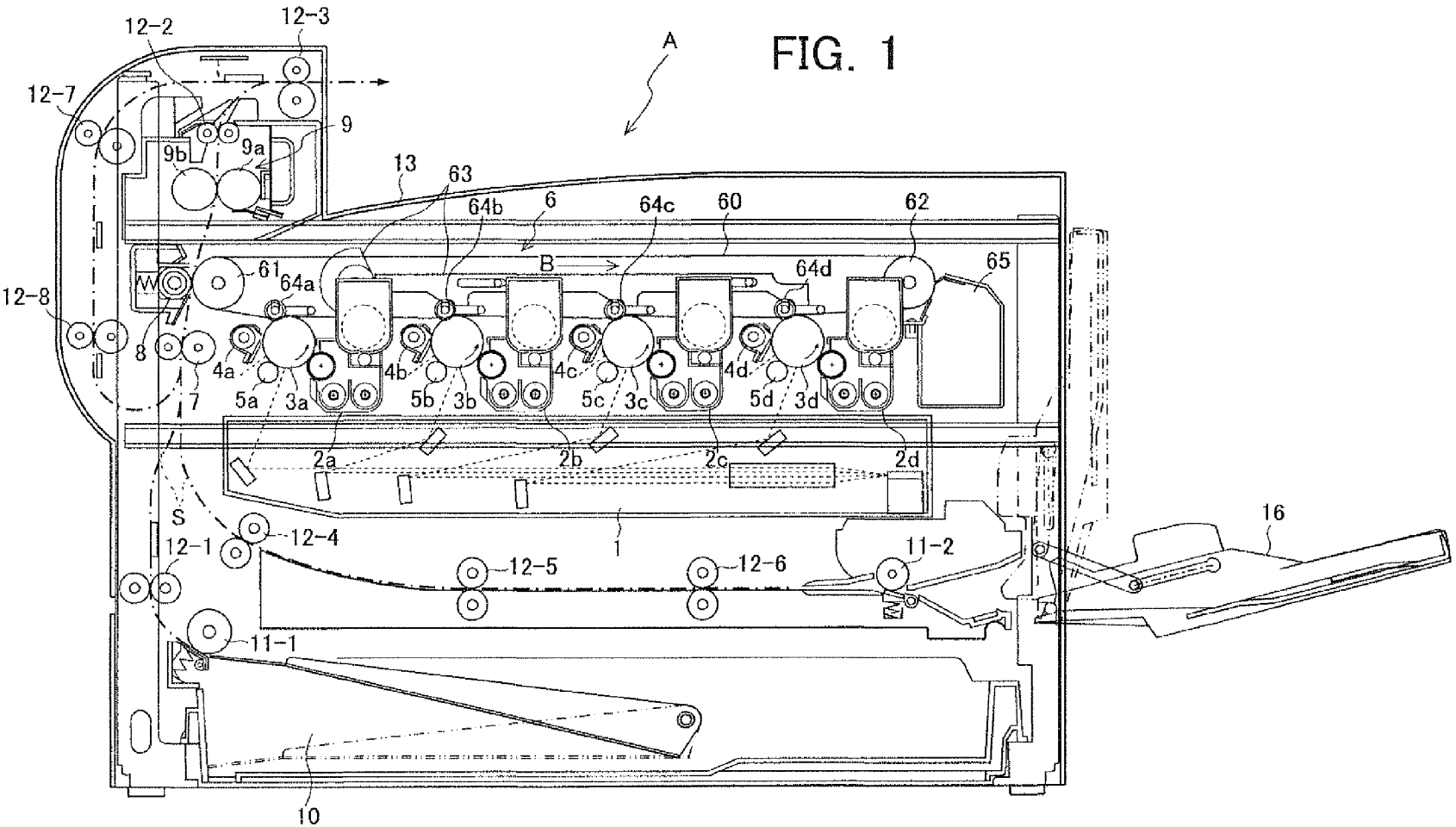
FIG. 1 is a sectional view schematically showing a structural example of an image forming apparatus according to an embodiment of the present technology.

FIG. 1 is a sectional view schematically showing a structural example of an image forming apparatus according to an embodiment of the present technology, where A denotes the image forming apparatus. The image forming apparatus A illustrated in FIG. 1 forms a multi-color or single-color image on a predetermined sheet (a recording paper) based on image data transmitted from the outside.

In addition, as shown in the figure, the image forming apparatus A is composed of an exposure unit 1, developing apparatuses 2 (2*a*, 2*b*, 2*c*, and 2*d*), photoreceptor drums 3 (3*a*, 3*b*, 3*c*, and 3*d*), cleaner units 4 (4*a*, 4*b*, 4*c*, and 4*d*), charging devices 5 (5*a*, 5*b*, 5*c*, and 5*d*), an intermediate transfer belt unit 6, a resist roller 7, a transfer roller 8, a fixing unit 9, a paper feed tray 10, a sheet transport path S, a paper discharge tray 13, and the like.

Note that, image data dealt with in the image forming apparatus A corresponds to a color image using each color of black (K), cyan (C), magenta (M), and yellow (Y). Hence, the developing apparatuses 2 (2*a*, 2*b*, 2*c*, and 2*d*), the photoreceptor drums 3 (3*a*, 3*b*, 3*c*, and 3*d*), the cleaner units 4 (4*a*, 4*b*, 4*c*, and 4*d*), and the charging devices 5 (5*a*, 5*b*, 5*c*, and 5*d*) are respectively provided as many as four so as to form four kinds of latent images corresponding to each color. In addition, a, b, c, and d correspond to black, cyan, magenta, and yellow, respectively, and four image stations are disposed. Note that, a color image is formed using four colors in this way in FIG. 1, however, in the present technology, any image formation is applicable as far as it is possible to perform multi-color image formation, for example, using six colors, and monochrome image formation is also applicable.

The exposure unit 1 can employ not only a technique using a laser scanning unit (LSU) comprised of a laser emitting portion and a reflecting mirror as shown in FIG. 1, but also a technique using an EL (Electro Luminescence) or LED (Light Emitting Diode) writing head having light-emitting devices arrayed. Moreover, the exposure unit 1 has a function of exposing the charged photoreceptor drums 3 based on input image information so as to form, on the surfaces thereof, electrostatic latent images based on the image data.

Note that, image information may be input from a computer or a facsimile line externally connected to the image forming apparatus A, and image information can be obtained also by optically reading a document with a document reading portion in a case where the image forming apparatus A is provided with the document reading portion, and by converting to a digital signal in the case of an analogue signal.

The developing apparatuses 2 visualize the electrostatic latent images formed on each of the photoreceptor drums 3 by using toners of K, C, M, and Y, and details thereof will be described below. The cleaner units 4 remove and collect toner remaining on the surfaces of the photoreceptor drums 3 after development and image transfer.

The photoreceptor drums 3 are disposed (mounted) in an upper part of the image forming apparatus A. The charging devices 5 are charging means for charging the surfaces of the photoreceptor drums 3 uniformly at a predetermined electric potential, and examples thereof include a roller type or brush type charging device in a contact type as shown in FIG. 1 or a charger type charging device.

The intermediate transfer belt unit 6 disposed above the photoreceptor drums 3 includes an intermediate transfer belt 60, an intermediate transfer belt driving roller 61, an intermediate transfer belt driven roller 62, an intermediate transfer belt tension mechanism 63, intermediate transfer rollers 64 (64*a*, 64*b*, 64*c*, and 64*d*), and an intermediate transfer belt cleaning unit 65. The intermediate transfer belt driving roller 61, the intermediate transfer belt driven roller 62, the intermediate transfer belt tension mechanism 63, the intermediate transfer rollers 64, and the like stretch and support the intermediate transfer belt 60 so as to rotationally drive the intermediate transfer belt 60 in a direction indicated by an arrow B.

The intermediate transfer belt 60 is disposed so as to be in contact with each of the photoreceptor drums 3. In addition, the intermediate transfer belt 60 has a function of forming a colored toner image (a multi-color toner image) on the intermediate transfer belt 60 by sequentially superimposing and transferring, onto the intermediate transfer belt 60, toner images with respective colors formed on the photoreceptor drums 3. The intermediate transfer belt 60 is formed as an endless belt using a film whose thickness is, for example, 100 μm to 150 μm.

Toner images are transferred from the photo receptor drums 3 onto the intermediate transfer belt 60 by the intermediate transfer rollers 64 that are in contact with a rear side of the intermediate transfer belt 60. The intermediate transfer rollers 64 are supported rotatably by an intermediate transfer roller attaching portion of the intermediate transfer belt tension mechanism 63 in the intermediate transfer belt unit 6, for applying a transfer bias to transfer the toner images on the photoreceptor drums 3 onto the intermediate transfer belt 60. A transfer bias having a high voltage (a high voltage having a polarity (+) opposite to a charging polarity (−) of toner) is applied to the intermediate transfer rollers 64 to transfer toner images. Each of the intermediate transfer rollers 64 is a roller made of a metal (for example, stainless steel) axis whose diameter is 8 through 10 mm as a base, and the surface of which is covered with a conductive elastic material such as Ethylene Propylene Diene Methylene Linkage (EPDM) or urethane foam. The conductive elastic material enables a high voltage to be applied to the intermediate belt uniformly. Although a roller-shaped transfer electrode is used as a transfer electrode in FIG. 1, in addition, a brush-shaped electrode and the like can be used.

As described above, electrostatic images visualized on the photoreceptor drums 3 according to each hue are laminated on the intermediate transfer belt 60 so that images indicated by the image information input to the image forming apparatus A are formed. In this way, the laminated image information is transferred onto a paper by the transfer roller 8, which will be described below, disposed at a position where the paper is in contact with the intermediate transfer belt 60 with rotation of the intermediate transfer belt 60.

At that time, the intermediate transfer belt 60 is in press-contact with the transfer roller 8 with a predetermined nip, and a voltage (a high voltage having a polarity (+) opposite to a charging polarity (−) of toner) for transferring the toner onto the paper is applied to the transfer roller 8. Moreover, in order to constantly obtain the aforementioned nip by the transfer roller 8, one of the transfer roller 8 and the intermediate transfer belt driving roller 61 uses a hard material (such as metal) and the other uses a soft material (such as an elastic rubber roller or an expandable resin roller), including an elastic roller.

Moreover, toner attached to the intermediate transfer belt 60 due to contact with the photoreceptor drums 3 or toner remaining on the intermediate transfer belt 60 because transfer onto a paper was not performed by the transfer roller 8 causes mixture of colors of toner in the following step, and therefore, the attached toner or remaining toner is set up to be removed and collected by the intermediate transfer belt cleaning unit 65. The intermediate transfer belt cleaning unit 65 includes, for example, a cleaning blade as a cleaning member contacting with the intermediate transfer belt 60, and the intermediate transfer belt 60 which is in contact with the cleaning blade is supported by the intermediate transfer belt driven roller 62 from the rear side.

The paper feed tray 10 is a tray to store sheets (recording papers) used for image formation, and is disposed under an image forming portion and the exposure unit 1 of the image forming apparatus A. In addition, the paper discharge tray 13 disposed in the upper part of the image forming apparatus A is a tray to place printed sheets so that printed sides of the sheets face downward.

Moreover, the image forming apparatus A is provided with an almost vertical shaped sheet transport path S to convey a sheet in the paper feed tray 10 through the transfer roller 8 and the fixing unit 9 to the paper discharge tray 13. Further, in a vicinity of the sheet transport path S between the paper feed tray 10 and the paper discharge tray 13, there are provided pickup rollers 11 (11-1 and 11-2), a resist roller 7, the transfer roller 8, a heat roller 9*a* and a pressure roller 9*b* of the fixing unit 9, transport rollers 12 (12-1 to 12-8) for transporting sheets, and the like. That is, the sheet transport path S is formed by a group of these rollers.

The transport rollers 12 are small rollers to facilitate/assist transportation of a sheet and are disposed in plural pieces along the sheet transport path S. The pickup roller 11-1 is provided at an end of the paper feed tray 10 and serves as an attracting roller for supplying sheets to the sheet transport path S one by one.

The resist roller 7 is a roller that temporarily holds a sheet transported through the sheet transport path S. In addition, the resist roller 7 has a function of transporting the sheet to a transfer portion including the transfer roller 8 at a timing when ends of toner images on the photoreceptor drums 3 are overlapped with an end of the sheet.

The fixing unit 9 includes the heat roller 9*a*, the pressure roller 9*b*, and the like, and the heat roller 9*a* and the pressure roller 9*b* rotate so as to sandwich a sheet therebetween. Moreover, the heat roller 9*a* is set so as to have a predetermined fixing temperature by a control portion based on a signal from a temperature detecting device (not shown in the figure), and has a function of performing thermo compression of a sheet together with the pressure roller 9*b*, and thereby causing multi-colored toner images transferred onto the sheet to be fused/mixed/pressed, so as to heat and fix the toner images onto the sheet.

Note that, the sheet to which the multi-colored toner images have been fixed is transported to an inverse paper discharge path of the sheet transport path S by the transport rollers 12-2 and 12-3, and discharged onto the paper discharge tray 13 so as to be in an inverted state (so that the multi-colored toner images face downward).

Next, the sheet transport path will be described in detail. The image forming apparatus A is provided with a paper feed cassette 10 which stores sheets in advance and a manual feed tray 16 which requires no operation of opening/closing the paper feed cassette 10 when a user prints a few papers. The manual feed tray 16 is also provided with the pickup roller 11-2. In this way, both of the paper feed trays are provided with the pickup rollers 11, respectively, so as to lead sheets to the transport path one by one.

A sheet transported from the paper feed cassette 10 is transported to the resist roller 7 by the transport roller 12-1 in the sheet transport path, and transported to the transfer roller 8 at a timing when an end of the sheet is overlapped with an end of image information on the intermediate transfer belt 60, so that the image information is written onto the sheet. Thereafter, the sheet passes through the fixing unit 9 so as to fuse and fix unfixed toner images on the sheet, and then the sheet is discharged from the transport roller (the paper discharge roller) 12-3 through the transport roller 12-2 onto the paper discharge tray 13 (in a case where single sided printing is requested).

On the other hand, a sheet placed on the manual paper feed tray 16 is fed by the pickup roller 11-2 and delivered through a plurality of transport rollers 12-6, 12-5, and 12-4 to the resist roller 7, and thereafter discharged onto the paper discharge tray 13 via the process same as in the sheet fed from the paper feed cassette 10 (in a case where single sided printing is requested).

In a case where double sided printing is requested, a back end of the sheet having been subjected to single side printing and having passed through the fixing unit 9 as described above is held by the paper discharge roller 12-3, and the sheet is then led to the transport rollers 12-7 and 12-8 by inverse rotation of the paper discharge roller 12-3, followed by being subjected to back side printing through the resist roller 7 so as to be discharged onto the paper discharge tray 13.

Figure 2:
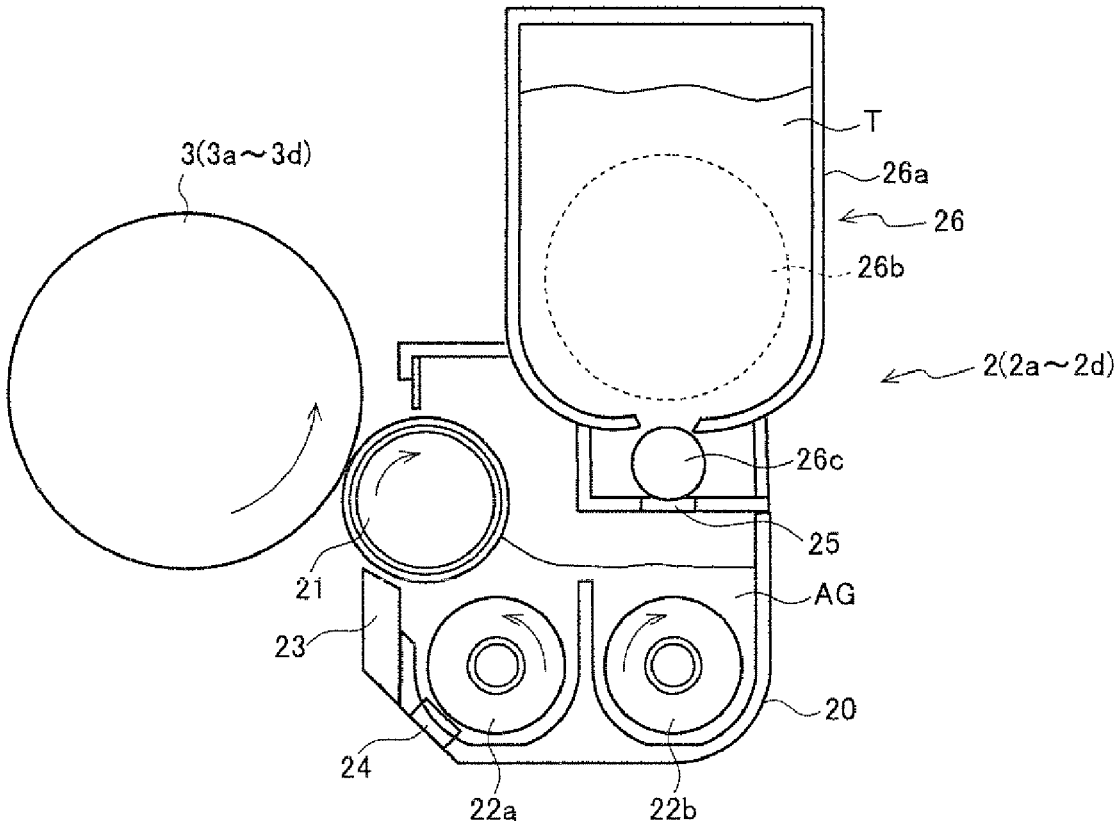
FIG. 2 is an enlarged view of a developing apparatus and a photoreceptor drum in the image forming apparatus of FIG. 1.

The image stabilizing apparatus according to the present technology controls so as to make a concentration of toner in the developing apparatus 2 constant and newly perform toner replenishment after forced discharge of developer (ejection same as in solid black), in order to prevent that a development density (a printing density) decreases when documents having a low print coverage continue. FIG. 2 is an enlarged view of the developing apparatus 2 and the photoreceptor drum 3 in the image forming apparatus of FIG. 1.

The developing apparatus 2 is provided to develop electrostatic latent images formed on the photoreceptor drums 3 as an example of an image bearing member into toner images. The developing apparatus 2 has a developer container 20 for storing two-component developer AG including toner and carrier, a developing roller 21 which is arranged so as to be close to the photoreceptor drum 3 in an opposed state for supplying the two-component developer AG in the developer container 20 to the photoreceptor drum 3, two conveying screws 22*a* and 22*b* for conveying the two-component developer AG in the developer container 20 toward the developing roller 21 while agitating, a doctor blade 23 for regulating an amount of developer to the developing roller 21, and a toner concentration sensor 24. The toner concentration sensor 24 detects a toner concentration in the two-component developer AG in the developing apparatus by detecting a magnetic permeability of the two-component developer AG in the developer container 20, and is referred to also as a magnetic permeability sensor.

The developer container 20 has an opening 25 for replenishing toner into the inside thereof at an upper part, and toner is newly replenished from the toner replenishing apparatus 26 arranged above. The toner replenishing apparatus 26 has a toner container 26*a* for storing toner, a toner agitating member 26*b* for agitating the toner T stored in the toner container 26*a*, and a toner replenishing roller 26*c* for supplying the toner in the toner container 26*a* while agitating, wherein the toner T is replenished to the developing apparatus 2 through the opening 25.

Figures 3, 4:
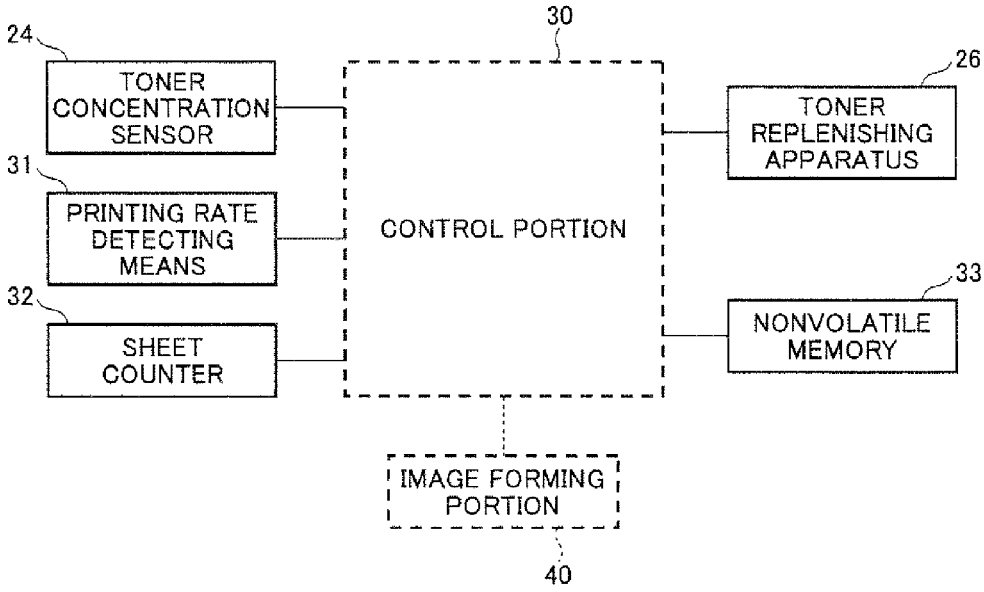
FIG. 3 is a block diagram showing an example of an image stabilizing apparatus according to an embodiment of the present technology.
FIG. 4 is a view showing an example of a table used when controlling toner replenishment and discharge based on document print coverage detecting means at a control portion in the image stabilizing apparatus of FIG. 3.

FIG. 3 is a block diagram showing an example of the image stabilizing apparatus according to an embodiment of the present technology. The image stabilizing apparatus (the image quality stabilizing apparatus) illustrated in FIG. 3 is an apparatus provided in the aforementioned image forming apparatus A for stabilizing an image formed by performing control of a toner concentration (control of toner replenishment). The image stabilizing apparatus is formed such that the toner concentration sensor 24 and the toner replenishing apparatus 26 for replenishing toner to the developer container 20, which have been described above, and print coverage detecting means (a print coverage detecting portion) 31, a sheet counter 32, a nonvolatile memory such as an EEPROM (Electronically Erasable and Programmable ROM) are connected to control means (the control portion) 30. However, an image forming apparatus to which the image stabilizing apparatus illustrated in the figure is applicable is not limited to the image forming apparatus A illustrated in FIGS. 1 and 2.

Furthermore, FIG. 3 illustrates the control portion 30 as a portion which performs control mainly for a part involving image formation (illustrated as an image forming portion 40) except for the developing apparatus 2 in the image forming apparatus A. That is, the image forming portion 40 is composed of the exposure unit 1, the photoreceptor drums 3, the cleaner unit 4, the charging devices 5, the intermediate transfer belt unit 6, the resist roller 7, the transfer roller 8, the fixing unit 9, the paper feed tray 10, the pickup roller 11, the transport rollers 12, and the like, which have been described above, and prints an image eventually on a sheet based on image information of an input document with control from the control portion 30. In this way, the control portion 30 of the image stabilizing apparatus may be configured so as to be included in the control portion of the entire image forming apparatus A.

The control portion 30 includes, for example, a CPU (Central Processing Unit), a program storage memory such as a ROM (Read Only Memory) for storing therein a control program for execution of various kinds of control including control of toner replenishment/discharge according to the present technology, and a work memory such as a RAM (Random Access Memory) for reading the control program, storing data in processing temporarily and the like as a work area of the CPU.

The print coverage detecting means 31 calculates a print coverage of a document image (a print coverage of a document), that is, a rate of a printing pixel (a pixel to form a dot of toner) to all pixels of the document image, based on image information of the input document, including density information of the input document, any information of a printing pixel area and a solid black rate of the input document. The print coverage detecting means 31 is referred to also as dot detecting means due to obtaining a rate of the image to all pixels by counting dots. The print coverage detecting means 31 obtains image information of the input document from the control portion 30 and returns a print coverage of the document to the control portion 30. The nonvolatile memory 33 is a memory for storing the print coverage by an instruction from the control portion 30, and a volatile memory may be employed instead, however, the volatile memory separately requires a power source. Note that, the print coverage detecting means 31 and the nonvolatile memory 33 may be configured so as to be included in the control portion 30.

The sheet counter 32 counts the number of sheets subjected to image formation with a predetermined timing as a starting point of the count, and provides the counted value to the control portion 30. Moreover, as the toner concentration sensor 24, a magnetic permeability sensor is used, and an output signal indicating a toner concentration which is the detection result is also input to the control portion 30. Since the magnetic permeability sensor is used as the toner concentration sensor 24, the output varies in proportion to a concentration of carrier in the two-component developer AG. Thus, the output of the toner concentration sensor decreases as the toner concentration in the two-component developer AG increases.

With the structure described above, the control portion 30 uses values detected by the print coverage detecting means 31, the sheet counter 32, and the toner concentration sensor 24 to control toner replenishment in the toner replenishing apparatus 26 and forced discharge of toner for the photoreceptor drum 3.

As the control of toner replenishment/discharge, the control portion 30 controls the toner replenishment amount in the toner replenishing apparatus 26 based on the toner concentration detected by the toner concentration sensor 24 and the detection result of the document print coverage by the print coverage detecting means 31, and when the document print coverage detected by the print coverage detecting means 31 is less than a predetermined value and such documents continue, controls so as to discharge a predetermined amount of toner by developing to the photoreceptor drum 3 forcibly (ejection same as in solid black), and to replenish a same amount of toner every time. The control of the toner replenishment amount in accordance with a toner concentration is conventional control in which as the toner concentration is reduced, the toner replenishment amount is increased accordingly. In addition, the forced toner discharge by developing can be executed by transferring toner near the developing roller 21 to the photoreceptor drum 3 (ejection same as in solid black). Specifically, after charging the photoreceptor drum 3 uniformly, laser light is irradiated thereto to form a solid latent image, so that a solid toner image is formed thereon by the developing apparatus. The aforementioned predetermined amount (the amount of discharge by developing) can be controlled by an area to which the laser light is irradiated. Such a process is performed to refresh the toner near the developing roller 21.

Hence, it is possible to prevent deterioration of toner that occurs because the toner on the developing roller 21 circulates for a long time near the developing roller 21 without being consumed, thus making it possible to suppress decrease in an image density due to the toner deterioration.

Moreover, when such an image stabilizing apparatus is provided in an image forming apparatus like the image forming apparatus A, it is possible to maintain image quality without decrease in the image density for a long time.

FIG. 4 is a view showing an example of a table used for controlling toner replenishment and discharge based on the document print coverage detecting means at the control portion in the image stabilizing apparatus of FIG. 3, where 30*a* denotes a table stored in an internal memory of the control portion 30 (or the nonvolatile memory 33).

In addition to the table 30*a*, information indicating a replenishment amount depending on a concentration for conventional control of a toner replenishment amount depending on detection result of a toner concentration (not shown in the figure, hereinafter referred to as concentration conversion information) is also stored in the control portion 30. The concentration conversion information is, for example, a predetermined value of a toner concentration (a fixed value) that is referred to when a toner replenishment amount in the toner replenishing apparatus 26 is controlled depending on the toner concentration detected by the toner concentration sensor 24 as described above. The control portion 30 performs automatic control (feedback control) such that, based on the detection result from the toner concentration sensor 24, when the toner concentration is decreased, the toner replenishment amount is increased accordingly so as to approach the toner concentration to the fixed value.

The table 30*a* illustrated in FIG. 4 is a correspondence table which is referred to by the control portion 30 when carrying out control of the forced toner discharge and control of the toner replenishment amount based on a print coverage of a document, as described above. In the table 30*a*, a predetermined value (a threshold) for the forced toner discharge by developing is set at 3%. The control portion 30 turns the control of the discharge by developing ON in a case of being less than the predetermined value, and turns the control of the discharge by developing OFF in a case other than the case above. In this way, when the print coverage of the document detected by the print coverage detecting means 31 is less than the predetermined value (3% in the present example), the control portion 30 performs the forced toner discharge by developing. This control enables to suppress wasteful consumption of toner and to secure toner yield.

Moreover, in the table 30*a*, replenishment amounts (toner replenishment amounts to be dripped) at the time of carrying out the control of toner replenishment for the toner replenishing apparatus 26, are also defined with respect to three ranges of print coverages. More specifically, toner replenishment amounts to be dripped are set as "large", "medium", and "small" with respect to "less than 3%", "over 3% and less than 7%", and "over 7%" of the document print coverages, respectively. That is, in the case of less than 3%, the toner replenishment amount to be dripped is increased because detection of a toner concentration by the toner concentration sensor 24 is delayed, on the other hand, in the case of over 7%, the toner replenishment amount to be dripped is decreased because detection by the toner concentration sensor 24 is relatively quickly obtained. Note that, actual toner replenishment amounts to be dripped are set for "large", "medium", and "small", respectively.

Such replenishment based on the detection result of a print coverage by the print coverage detecting means 31 aims to supplement automatic replenishment control based on the detection result by the magnetic permeability sensor 24, as described above. That is, although the control portion 30 controls a replenishment amount with respect to the toner replenishing apparatus 26 depending on both detection results, the controls based on respective detection results are basically performed separately. More specifically, while the control of toner replenishment amount based on the toner concentration sensor 24 is basically carried out, the output of the toner concentration sensor 24 varies in proportion to a concentration of carrier in the two-component developer AG, thus the output decreases as the toner concentration in the two-component developer AG increases. However, since the toner replenishment by the toner concentration sensor 24 takes a time as described above, in order to supplement that, the forced toner replenishment (toner drip) based on a document print coverage is performed simultaneously, as shown in the table 30*a*. Here, in the case of a document having a low print coverage, the replenishment is performed by setting the amount of forced replenishment to be large. By performing such control in addition, it is possible to secure similar printing quality stably corresponding to any print coverages.

Figure 5:
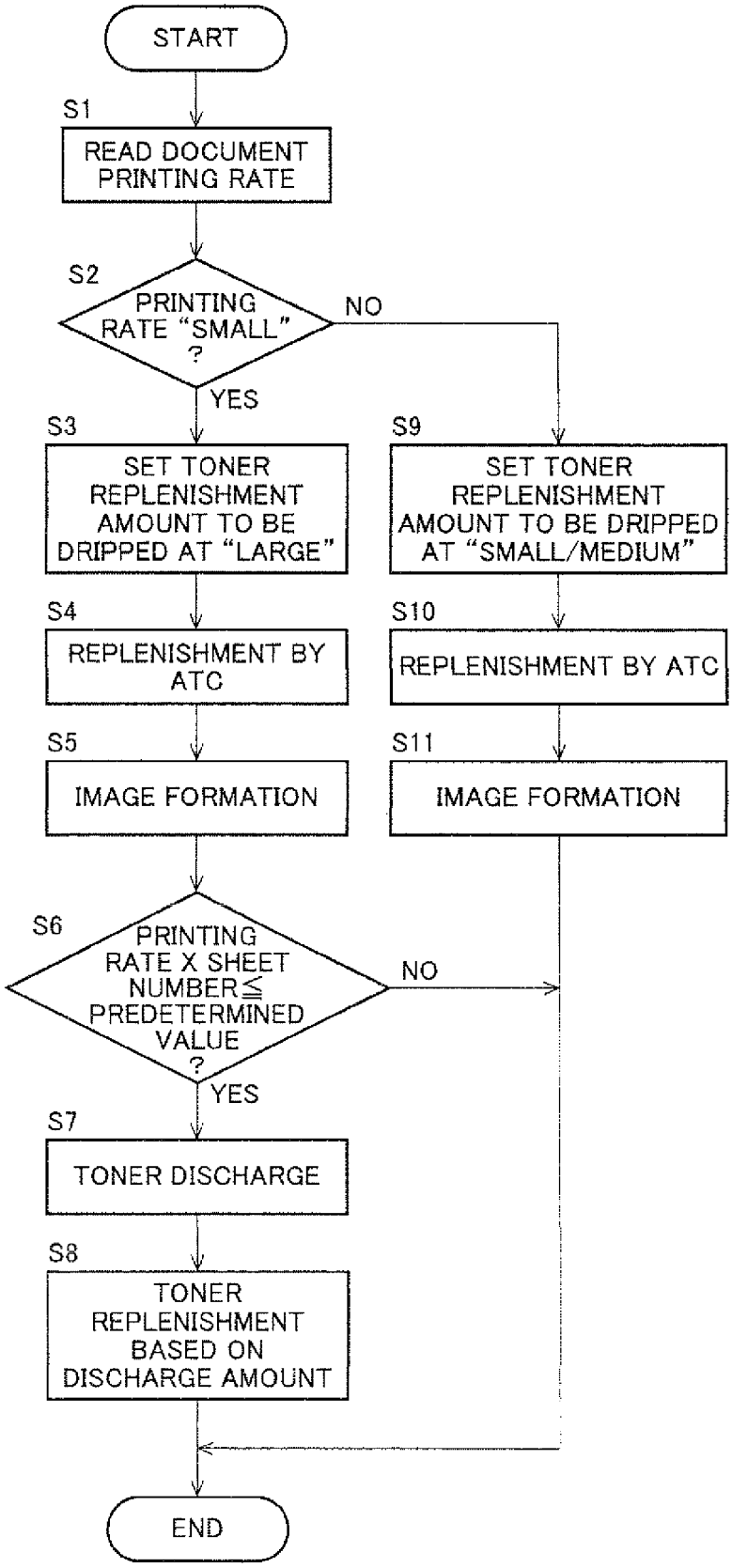
FIG. 5 is a flowchart illustrating an example of the control at the control portion in the image stabilizing apparatus of FIG. 3.

FIG. 5 is a flowchart illustrating an example of control by the control portion in the image stabilizing apparatus of FIG. 3. Referring to FIG. 5, an example of the aforementioned control of the toner replenishment/discharge in the control portion 30 will be described.

When a printing process is started based on a printing command, the control portion 30 firstly gives an instruction of reading a print coverage of a document to be printed to the print coverage detecting means 31 to obtain the result (step S1). For example, an average document print coverage in one printing job is read. Subsequent to step S1, the control portion 30 determines whether or not the print coverage is "small" by referring to the table 30*a* (step S2), when the print coverage is large or medium, the procedure proceeds to step S9, and when the print coverage is small, the procedure proceeds to step S3.

In a process at step S9, when the print coverage is "large"/"medium", the toner replenishment amounts to be dripped depending on the print coverage are set at "small"/"medium" based on information in the table 30*a*, respectively, and the toner replenishing apparatus 26 carries out replenishment by dripping. Subsequently, automatic toner replenishment by the toner concentration sensor 24, that is, replenishment by ATC (Auto Toner Control) is also performed (step S10), and normal image formation is then performed (step S11). Thereafter, the process is completed. Note that, the start of control at step S9 and that at step S10 may be performed out of sequence.

At step S3, similarly to at step S9, the toner replenishment amount to be dripped depending on a print coverage is set at "large" based on the information in the table 30*a*, and the toner replenishing apparatus 26 carries out replenishment by dripping. Subsequently, similarly to at steps S10 and S11, the replenishment by ATC is performed (step S4), and control of the normal image formation is performed for the image forming portion 40 so as to perform the normal image formation (step S5). Note that, the start of control at step S3 and that at step S4 may be performed out of sequence.

When the print coverage is "small", not only such processes but following steps are performed in addition. First, after the process at step S5, the control portion determines whether or not a print coverage of a document detected by the print coverage detecting means 31 is less than a predetermined value (3% in the present example) and such documents continue (step S6). At step S6, in order to determine a case that documents having a print coverage less than 3% continue, it is determined whether or not a ratio of the document print coverage to an operation time of the developing apparatus 2 (a ratio of a value obtained by multiplying an average print coverage and the number of printed sheets to a predetermined development time) is equal to or less than the predetermined value. More specifically, at the time when the number of printed sheets counted by the sheet counter 32 reaches 50 A4-sized sheets, it is determined based on whether or not the average print coverage is less than 3% and the like by referring to the table 30*a*. The average print coverage is calculated until the number of printed sheets reaches 50 A4-sized sheets such that the print coverage detecting means 31 stores detected document print coverages in the nonvolatile memory 33 while accumulating, and simultaneously provides the control portion 30 with an average value of the document print coverages until the number of printed sheets reaches 50 A4-sized sheets in the control portion 30. Then, data in the nonvolatile memory 33 is reset at the time when discharge by developing is carried out (not shown in the figure). In this way, by storing data from the time when the previous discharge by developing is performed, it is possible to perform control of a toner concentration more securely and stably. The timing of carrying out the discharge by developing is not limited to the timing when the number of printed sheets reaches sheets, it may be any timing as far as it is a predetermined timing for performing discharge by developing. It is also possible to change the predetermined value by a user.

In the case of YES at step S6, toner development to the photoreceptor drum 3 (forced discharge of toner, that is, ejection similar as that in solid black) is carried out (step S7), and subsequently, toner in the amount same as that of toner discharged at step S7 is replenished by the toner replenishing apparatus 26 (step S8) to complete the process. That is, at step S8, toner in the amount matching the amount corresponding to a predetermined image solid density is newly replenished. Alternatively, in the case of NO at step S6, the process is completed without proceeding to steps S7 and S8.

Moreover, in step S2, when a process speed of the image forming apparatus A (that is, a rotational speed of the photoreceptor drum 3) is reduced, a rotational speed of the developing roller 21 is reduced accordingly, thus a speed of toner deterioration is also delayed. Hence, by reducing thresholds of a document print coverage, for example, from 3% and 7% to 2% and 6%, respectively, it is possible to further suppress toner consumption. The thresholds of the document print coverage may be changed depending on the process speed of the image forming apparatus A. That is, the control portion 30 may be provided so as to obtain a rotational speed of the photoreceptor drum 3 and, depending on the rotational speed, change the thresholds of the document print coverage by the print coverage detecting means 31 concerning the replenishment amount. By performing such control in combination, it is possible to further suppress decrease in an image density in accordance with a state of toner deterioration.

Moreover, although the toner discharge amount at step S7 was defined as the predetermined amount, the toner discharge amount may be changed depending on the average print coverage of document. That is, when the average print coverage of document is extremely small, it is assumed that the deterioration of toner is increased, and therefore by changing the amount of toner discharge to be increased, it is possible to further suppress decrease in a printing density.

Furthermore, in accordance with a degree of the deterioration of the two-component developer AG, by increasing the number of forced toner discharge and toner replenishment involving the discharge, or the toner amount, it is possible to suppress decrease in a printing density more accurately. The degree of the deterioration is obtained as an average print coverage of document or a rotational speed of the photoreceptor drum 3, as described above, and the number or amount of forced discharge is increased as the average print coverage becomes lower, and the number or amount of forced discharge is increased as the rotational speed becomes higher.

As a test, print run aging that a document having 6% of print coverage is printed on A4-sized sheets with a developing apparatus for black (trade name: MX2700, manufactured by Sharp Corporation) was conducted, and a printing density after performing printing of a document having 2% of print coverage on 100 sheets was measured for every 30,000 sheets. The printing density was measured by changing the execution frequency of forced toner discharge and toner replenishment of the present technology to zero, once, and twice, and the effect was confirmed. In addition, the printing density was measured using a reflection densitometer (trade name: RD918, manufactured by Macbeth Corporation).

Table 1 shows the result. As shown in Table 1, it is found that higher printing density can be obtained as the frequency of forced toner discharge (ejection same as in solid black) becomes larger.

TABLE 1

| Lifetime of developer (sheets) | Frequency of forced toner discharge | Printing density | Notes |
|---|---|---|---|
| beginning | — | 1.40 | |
| 30,000 | none | 1.32 | Low printing density |
| 30,000 | once | 1.38 | |
| 30,000 | twice | 1.39 | |
| 60,000 | none | 1.29 | Low printing density |
| 60,000 | once | 1.36 | |
| 60,000 | twice | 1.37 | |

Moreover, the aforementioned processes at steps S7 and S8 are unnecessary in the normal image formation. Hence, in the actual image forming apparatus A, by performing when reaching a predetermined cumulative development time or in response to a timing of process control that is conducted regularly, it is possible to reduce an influence on a printing job and to eliminate a trouble of keeping a user waiting. In this way, it is preferable that the control portion 30 carries out control when reaching a predetermined cumulative development time or at a predetermined timing. By carrying out the control when reaching a predetermined cumulative development time, it is possible to suppress deterioration of toner at a fixed level, and by carrying out the control at a predetermined timing such as at the time that image forming is not carried out, it is possible to eliminate an influence on an execution time of a printing job by a process time of control of toner replenishment/discharge according to the present technology.

As described above, according to the image stabilizing apparatus of the present technology, it is possible to maintain a toner concentration and a printing density constant when toner consumption is small, and it is further possible to simplify systematically.

The invention claimed is:

1. An image stabilizing apparatus, comprising:

a developing apparatus which stores two-component developer including toner and carrier, for developing an electrostatic latent image formed on an image bearing member;

a magnetic permeability sensor for detecting a toner concentration in two-component developer in the developing apparatus;

a print coverage detecting portion for detecting a print coverage of a plurality of documents;

a toner replenishing apparatus for replenishing toner to the developing apparatus; and a control portion for controlling a toner replenishment operation of the toner replenishing apparatus depending on the toner concentration detected by the magnetic permeability sensor and the print coverage of documents as detected by the print coverage detecting portion, wherein when an average print coverage for a predetermined number of documents as detected by the print coverage detecting portion is less than a predetermined threshold value, the control portion causes a predetermined amount of toner to be forcibly developed onto the image bearing member, and wherein the control portion also causes the same predetermined amount of toner to be replenished into the developing apparatus by the toner replenishing apparatus.

2. The image stabilizing apparatus as defined in claim 1, wherein the control portion is configured to cause toner to be forcibly replenished when the average print coverage for a predetermined number of documents is below the predetermined threshold value independently of the toner concentration detected by the magnetic permeability sensor.

3. The image stabilizing apparatus as defined in claim 2, wherein the control portion changes the predetermined threshold value of the average print coverage depending on a rotational speed of the image bearing member.

4. The image stabilizing apparatus as defined in claim 1, further comprising a nonvolatile memory, wherein the print coverage detecting portion utilizes the nonvolatile memory to store data representing the average print coverage of a plurality of documents.

5. The image stabilizing apparatus as defined in claim 1, wherein the control portion varies the predetermined amount of toner that is forcibly developed onto the image bearing member and that is replenished into the developing apparatus depending on a degree of deterioration of the two-component developer.

6. An image forming apparatus which includes the image stabilizing apparatus as defined in claim 1.

7. The image forming apparatus as defined in claim 6, wherein the control portion carries out control when reaching a predetermined cumulative development time or at a predetermined timing.

8. The image stabilizing apparatus as defined in claim 5, wherein the control portion causes greater predetermined amounts of toner to be forcibly developed onto the image bearing member and replenished into the developing apparatus the greater the degree of deterioration of the two-component developer.

9. The image stabilizing apparatus as defined in claim 5, wherein the control portion causes greater predetermined amounts of toner to be forcibly developed onto the image bearing member and replenished into the developing apparatus the lower the average print coverage for the predetermined number of documents.

10. An image stabilizing apparatus, comprising:

a developing apparatus which stores two-component developer including toner and carrier, for developing an electrostatic latent image formed on an image bearing member;

a print coverage calculating unit that calculates an average print coverage for a plurality of documents;

a toner replenishing apparatus that replenishing toner to the developing apparatus; and a controller that controls toner replenishment operations of the toner replenishment apparatus, wherein when the an average print coverage for a predetermined number of documents is less than a predetermined threshold value, the controller causes a predetermined amount of toner to developed onto the image bearing member and the same predetermined amount of toner to be replenished into the developing apparatus by the toner replenishing apparatus.

11. The image stabilizing apparatus of claim 10, wherein the controller varies the predetermined threshold value for the average print coverage depending on a rotational speed at which the developing apparatus is operating.

12. The image stabilizing apparatus of claim 11, wherein the controller lowers the predetermined threshold value for the average print coverage when the rotational speed of the developing apparatus increases.

13. The image stabilizing apparatus of claim 10, wherein the controller varies the predetermined amount of toner to developed onto the image bearing member and replenished into the developing apparatus based on the average print coverage calculated by the print coverage calculating unit.

14. The image stabilizing apparatus of claim 13, wherein the controller causes increased amounts of toner to developed onto the image bearing member and replenished into the developing apparatus when the average print coverage decreases.

* * * * *